US006405010B2

(12) United States Patent
Ashikari et al.

(10) Patent No.: US 6,405,010 B2
(45) Date of Patent: Jun. 11, 2002

(54) TONER CARTRIDGE HAVING AN AGITATING PADDLE

(75) Inventors: Tsutomu Ashikari; Kazuo Joroku, both of Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/840,965

(22) Filed: Apr. 25, 2001

(30) Foreign Application Priority Data

May 26, 2000 (JP) ..... 2000-156544
May 26, 2000 (JP) ..... 2000-156545

(51) Int. Cl.[7] ..... G03G 15/08

(52) U.S. Cl. ..... 399/262; 399/256; 399/258; 399/263

(58) Field of Search ..... 399/119, 120, 399/262, 263, 254, 256, 258; 222/DIG. 1

(56) References Cited

FOREIGN PATENT DOCUMENTS

EP 0 749 052 A2 12/1996
EP 0 816 937 A2 1/1998

*Primary Examiner*—Arthur T. Grimley
*Assistant Examiner*—Hoang Ngo
(74) *Attorney, Agent, or Firm*—Smith, Gambrell & Russell, LLP

(57) ABSTRACT

A toner cartridge including a cartridge body for containing toner, an agitating paddle for agitating toner and a toner blocking/setting prevention member operative in cooperation with the agitating paddle for preventing toner in the cartridge body from blocking or setting is provided. The toner blocking/setting prevention member may include a contacting projection provided on an agitating wing of the agitating paddle which contacts with a delivering spiral to oscillate the same. Further, the toner blocking/setting member may include an oscillating plate which is repelled by the rotation of the agitating paddle to assist in agitating toner.

12 Claims, 7 Drawing Sheets

TONER CARTRIDGE HAVING AN AGITATING PADDLE

BACKGROUND OF THE INVENTION

1. Field of the Invention

The present invention relates to a toner cartridge applicable to an image forming apparatus such as a copying machine, a facsimile, a printer or the like.

2. Description of Related Art

A toner cartridge having a delivering spiral and an agitating paddle in its cartridge body has been proposed. In such a kind of toner cartridge, toner contained in the cartridge body is agitated by rotating the agitating paddle, so that toner blocking can be prevented. The word "toner blocking" means that toner, not agitated for a long time, sets of itself.

The toner agitated by the agitating paddle is delivered to an outlet port by the delivering spiral and then supplied to a developing device.

In the abovementioned toner cartridge, though toner in the vicinity of the agitating paddle during rotating is agitated, toner in the corners of the cartridge body and regions out of reach of the agitating paddle cannot be sufficiently agitated. Therefore, sometimes toner partly remains in the cartridge body and cannot be wholly supplied to the developing device.

SUMMARY OF THE INVENTION

A first object of the present invention is to provide a toner cartridge capable of wholly supplying toner in its cartridge body to a developing device or the like.

A second object of the invention is to provide a toner cartridge having a delivering spiral and an agitating paddle in its cartridge body so that toner in the cartridge body is agitated by the agitating paddle and the agitated toner is wholly delivered by the delivering spiral.

A third object of the present invention is to provide a toner cartridge in which toner blocking or setting in the cartridge body is prevented.

A toner cartridge according to the present invention includes a cartridge body for containing toner, an agitating paddle for agitating toner, and a toner blocking/setting prevention member operative in cooperation with the agitating paddle for preventing toner in the cartridge body from blocking or setting, the agitating paddle and the toner b locking/setting prevention member being. provided in the cartridge body.

In a toner cartridge according to an embodiment of the present invention, a delivering spiral comprises an elongated rotation shaft in the cartridge body and a spiral blade extended outward from the circumferential surface of the rotation shaft and continuously elongated in the longitudinal direction of the rotation shaft to form a spiral having a predetermined pitch; and the agitating paddle comprises an elongated rotation shaft disposed in parallel with the rotation shaft of the delivering spiral and a plurality of agitating wings protruded from the rotation shaft. The agitating wing of the agitating paddle is provided with a contacting projection which contacts with the spiral blade when the agitating paddle is rotated. The contacting projection functions as a toner blocking/setting prevention member. The contacting projection may be formed integrally with the agitating wing to constitute a part of the agitating wing. Preferably, the contacting wing has a width substantially equal to a pitch of the spiral blade.

With this structure, when a part of the agitating wing contacts with the spiral blade, the delivering spiral is oscillated to oscillate toner in the cartridge body, so that toner blocking can be prevented. Further, since the agitating wing contacts with the spiral blade only in a small width corresponding to a pitch, toner is prevented from being pressed against the spiral blade and setting. As a result, the amount of toner remaining in the cartridge body can be reduced.

The contacting projection may be provided on an arbitrary one or ones among the plurality of agitating wings.

With this structure, since only an arbitrary one or ones among the plurality of agitating wings contacts or contact with the spiral blade, the contacting range can be narrowed and thereby toner setting on the spiral blade can be further reduced. Furthermore, the manufacturing cost can be reduced in comparison with a case in which all of the agitating wings are provided with contacting projections respectively.

The abovementioned cartridge body may have a recessed section in the vicinity of one side surface thereof. In this case, the agitating paddle has two ranges in the longitudinal direction; that is, one range in which no agitating wing can be provided because of the recessed section, and the remaining range 16 in which agitating wings can be provided without interference with the recessed section. In this case, preferably, two agitating wings among the plurality of agitating wings are each provided with a contacting projection, and the two contacting projections are provided on the agitating wings within regions, each corresponding to three tenths of the whole of the range in which agitating wings can be provided, extending from each end of the range.

With this structure, the contact portions between the agitating wings and the spiral blade are limited to two potions capable of intensely oscillating the delivering spiral, so that the delivering spiral can be effectively and sufficiently oscillated.

In another embodiment of the present invention, a toner blocking/setting prevention member includes an oscillating plate, which is operated by the agitating paddle so as to assist in agitating toner. With this structure, since the oscillating plate assists in agitating toner in the cartridge body, stable toner supply can be achieved.

Where the cartridge body includes a region out of reach of the agitating effect of the agitating paddle, it is preferable to provide an oscillating plate in that region. Thereby, toner blocking can be prevented. As a result, the amount of toner remaining in the cartridge body can be reduced.

The abovementioned oscillating plate may comprise an elastic and flexible (preferably long) thin plate and be fixed in the curved state to the cartridge body at its both ends. With this structure, the oscillating plate, being in the curved state, is provided with repelling force, and therefore, its agitating effect can be increased.

Where the cartridge body has a top plate, the oscillating plate may be fixed to the top plate. With this structure, only by attaching the top plate having the oscillating plate fixed thereto, to a container section of the cartridge body, the oscillating plate can be easily disposed in the cartridge body. Accordingly, error in assembling the parts can be decreased.

The oscillating plate may be positioned in such a manner that the agitating paddle during rotating can repel the oscillating plate and the repelled oscillating plate can agitate toner. With this structure, the oscillating plate can be operated using the rotation of the agitating paddle. Therefore, with the simple structure, toner in the cartridge body can be effectively and sufficiently agitated.

The foregoing and other objects, features, aspects and advantages of the present invention will become more apparent from the following detailed description of embodiments of the present invention given with the accompanying drawings.

DESCRIPTION OF THE PREFERRED EMBODIMENTS

Figure 1:
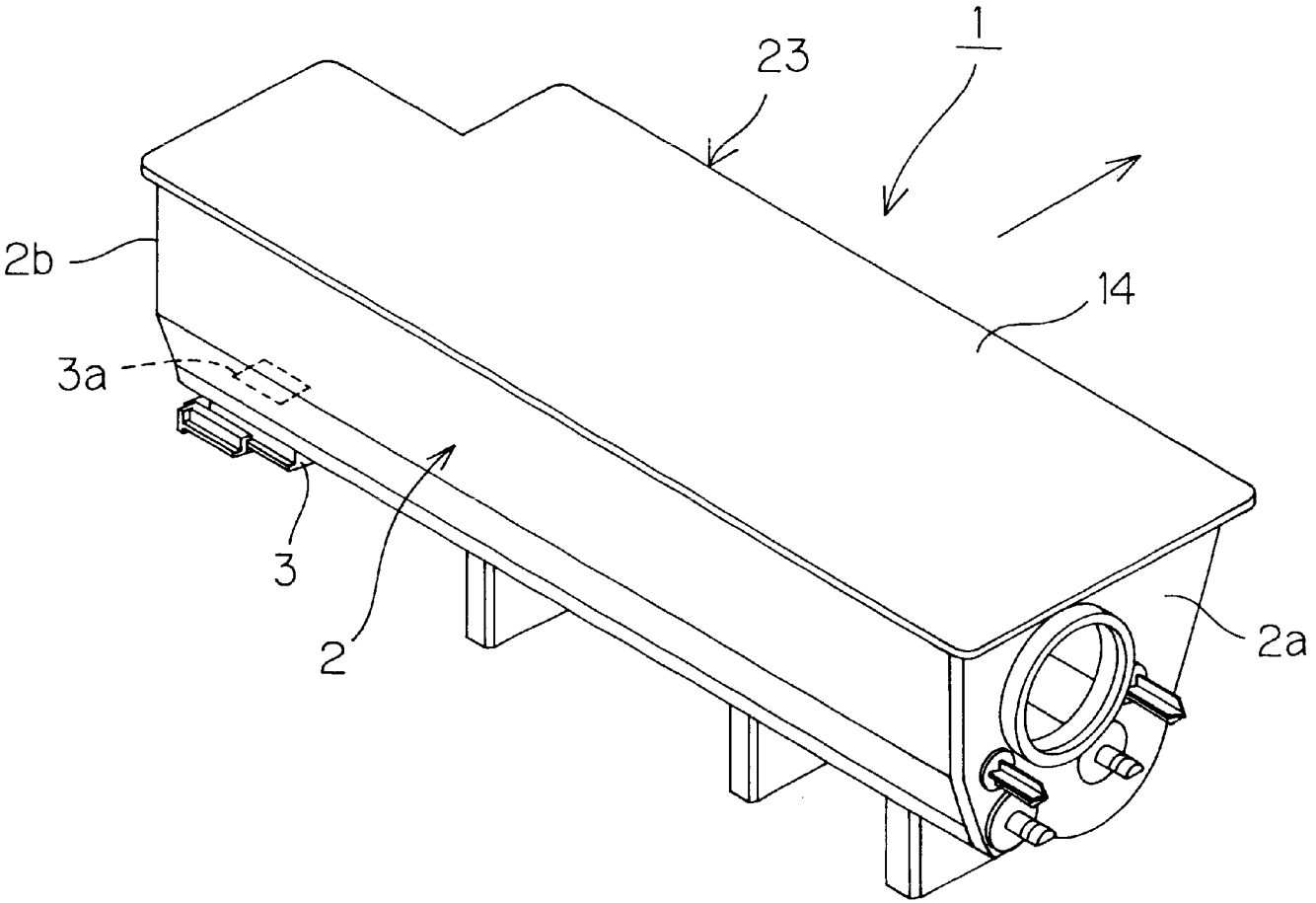
FIG. 1 is a perspective view, seen obliquely from an upper position, of a toner cartridge of an embodiment according to the present invention.

FIG. 1 is a perspective view, seen obliquely from an upper position, of a toner cartridge 1 according to an embodiment of the present invention. The toner cartridge 1 is constructed to supply toner. The toner cartridge 1 is, for example, loaded in a developing device in an image forming apparatus such as a copying machine and is used for supplying toner to the developing device at need.

The toner cartridge 1 comprises a cartridge body 23 for containing toner therein. The cartridge body 23 comprises a box-shaped container 2 with its upper surface opened and a top plate 14, and is provided with a recessed section in the vicinity of one side surface 2*b* (on the left back side in FIG. 1). The top plate 14 is fitted with the container 2 from upward so as to cover the upper opening of the container 2. The top plate 14, which is slightly larger in size than the upper opening of the container 2, is opposed to the upper opening. On the bottom surface of the container 2, an outlet portion 3 for allowing toner in the cartridge body 23 to fall into the developing device is provided, for example, in the vicinity of the side surface 2*b*. An outlet port 3*a* is provided in the upper surface of the outlet portion 3 so as to be communicated with an opening provided in the bottom of the container 2.

The toner cartridge 1 is loaded into the image forming apparatus in the direction toward the right back in FIG. 1. When the image forming apparatus loaded with the toner cartridge 1 is operated, toner in the cartridge body 23 is delivered to the outlet portion 3 and falls into the developing device.

Figure 2:
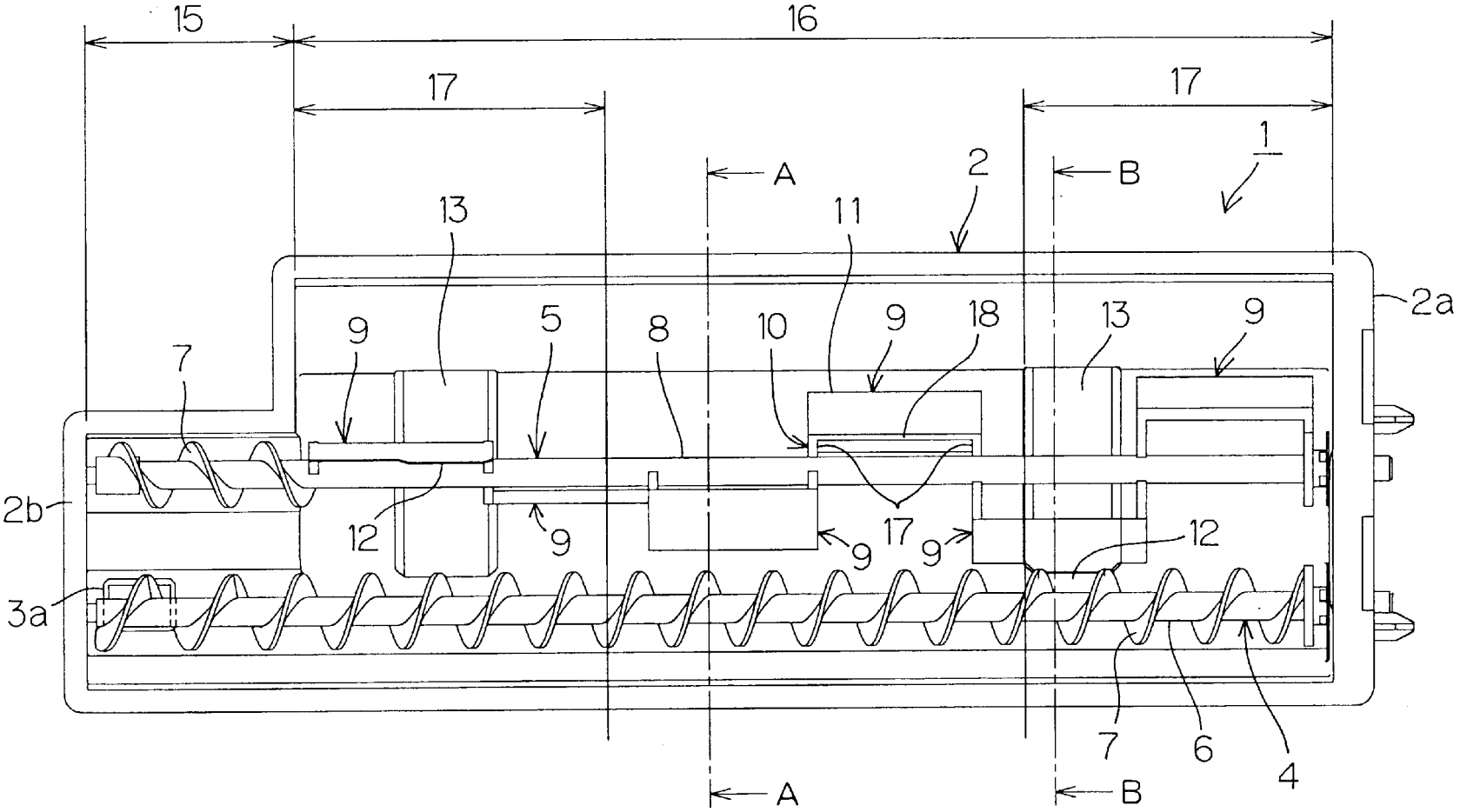
FIG. 2 is a plan view, seen from the right upper position, of the toner cartridge with a top plate detached therefrom
Figure 3:
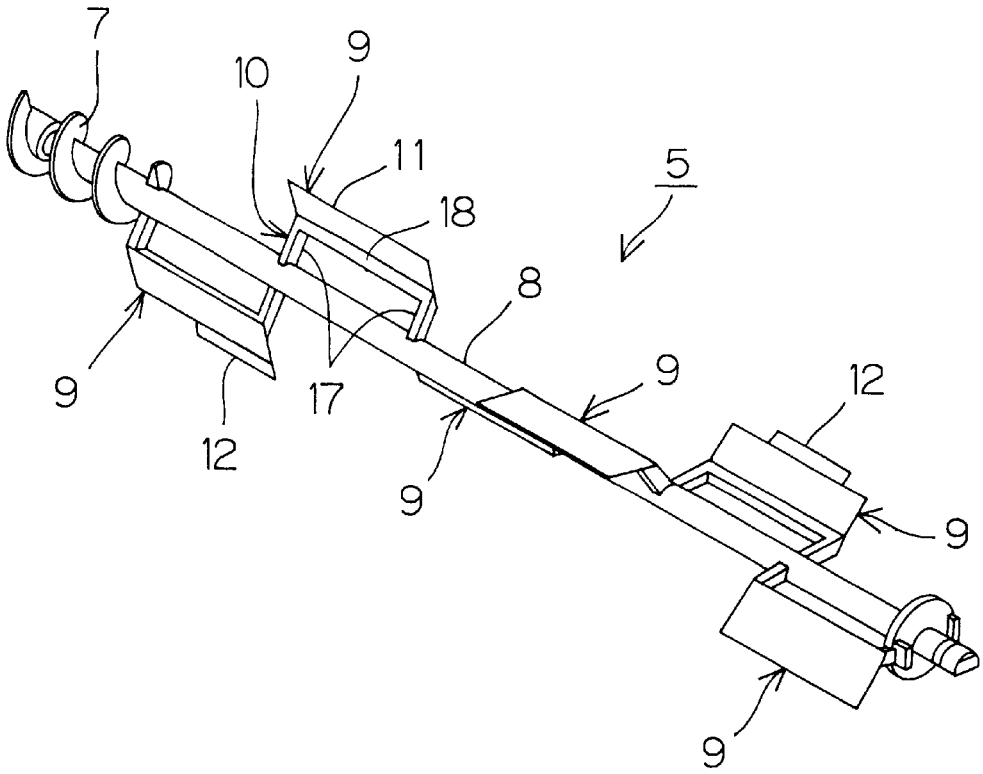
FIG. 3 is a perspective view, seen obliquely from an upper position, of an agitating paddle.

FIG. 2 is a plan view, seen from the right upper position, of the toner cartridge 1 with the top plate 14 detached therefrom. FIG. 3 is a perspective view, seen obliquely from an upper position, of an agitating paddle 5. In the container 2 of the toner cartridge 1, a delivering spiral 4 for delivering toner contained in the container 2 and an agitating paddle 5 for agitating toner are provided in such a manner that they are elongated in parallel with each other.

The delivering spiral 4 includes a rotation shaft 6. The rotation shaft 6 is formed in a long cylindrical shape elongated from one side surface 2*a* to the other side surface 2*b* of the container 2. A spiral blade 7 for delivering toner in the container 2 toward the outlet port 3*a* is extended outward from and along the circumferential surface of the rotation shaft 6 of the delivering spiral 4. The spiral blade 7 is continuously elongated in the longitudinal direction of the rotation shaft 6 to form a spiral having a predetermined pitch.

The agitating paddle 5 includes a rotation shaft 8. Similarly to the rotation shaft 6 of the delivering spiral 4, the rotation shaft 8 of the agitating paddle 5 is formed in a long cylindrical shape elongated from one side surface 2*a* to the other side surface 2*b* of the container 2. In this embodiment, the outer shape of the rotation shaft 6 of the delivering spiral 4 is substantially the same as that of the rotation shaft 8 of the agitating paddle 5. A plurality of agitating wings 9 for agitating toner in the container 2 protrude from the circumferential surface of the rotation shaft 8 of the agitating paddle 5. The agitating wings 9 are arranged adjacent to one another in order in the longitudinal direction of the rotation shaft 8.

The container 2 has a recessed section in the vicinity of the side surface 2*b*, and in the vicinity of this recessed section, there is a region in which no agitating wing can be provided. Therefore, the agitating paddle 5 has two ranges in the longitudinal direction; that is, one range 15 in the vicinity of one end thereof on the side surface 2*b* side in which no agitating wing can be provided, and the remaining range 16 in which agitating wings can be provided. It is possible to provide a spiral blade 7 on the circumferential surface of the rotation shaft 8 in the range 15 in which no agitating wing can be provided. By providing the spiral blade 7, toner in the vicinity of the range in which no agitating wing can be provided can be delivered.

In this embodiment, six agitating wings 9, constituted by three pairs, are provided. A pair of agitating wings 9 are opposed to each other with an angle of 180° therebetween, and three pairs of agitating wings 9 are disposed with an angle of 60° between one another when seen in a section crossing the rotation shaft 8. Each agitating wing 9 comprises a supporting arm 10 and a blade 11 supported by the supporting arm 10. The supporting arm 10 comprises two leg portions 17 and a connecting portion 18, and each end of the connecting portion 18 is connected to one end of each leg portion 17. The other end of each leg portion 17 is connected to the circumferential surface of the rotation shaft 8 in such a manner that each leg portion 17 protrudes vertically from the circumferential surface. Each blade 11 is formed of, for example, a thin plate, and has a width substantially equal to the length of the connecting portion 18. One side of the blade 11 is connected to the connecting portion 18 of the supporting arm 10 with a predetermined angle therebetween, so that the blade 11 is held with a predetermined space from the circumferential surface of the rotation shaft 8. Accordingly, when the agitating paddle 5 is rotated to agitate toner in the container 2, toner is prevented from accumulating and setting between the rotation shaft 8 and the agitating wing 9.

Further, among the six agitating wings 9, for example, the second agitating wing 9 counted from the side surface 2*a* side and the first agitating wing 9 counted from the side surface 2*b* side are each provided with a contacting projection 12 so that the agitating wings 9 contact with the spiral blade 7 of the delivering spiral 4. The contacting projection 12 is in the shape of, for example, a thin plate integrally formed on the head side of the blade 11 and having a width substantially equal to a pitch of the spiral blade 7. The contacting projections 12 are provided on the agitating wings 9 within ranges 17, each corresponding to three tenths of the whole of the range 16 in which agitating wings can be provided, and extending from each end of the range 16. By the rotation of the agitating paddle 5, the contacting projections 12 contact with the delivering spiral 4.

When the agitating wings 9 contact with the spiral blade 7, the delivering spiral 4 is oscillated to cause toner in the container 2 to be oscillated. As a result, toner blocking, which means that toner, not agitated for along time, sets of itself, can be prevented.

Further, tunnel phenomenon, in which toner only in the vicinity of the delivering spiral 4 is delivered by rotating the delivering spiral 4 with toner in the blocking state, can also be prevented. Furthermore, since the agitating wings 9 contact with the spiral blade 7 only at two portions and each in a small width corresponding to a pitch, toner is prevented from being pressed against the spiral blade 7 and setting.

The abovementioned members constituting the agitating paddle 5 may be integrally formed of, for example, a rather rigid polypropylene synthetic resin. However, the shape, number and material of the agitating wings 9 are not limited to those mentioned above. Further, the position and number of the contacting projections 12 are not limited to those mentioned above, but only one contacting projection 12 may be provided on an agitating wing 9 in the vicinity of the middle portion of the agitating paddle 5, or every agitating wing 9 may be provided with a contacting projection 12.

In the bottom surface of the container 2 below the two agitating wings 9 each provided with the contacting projection 12, recessed portions 13 are formed in correspondence with the contacting projections 12. The width of the recessed potion 13 is substantially equal to that of the contacting projection 12.

Figure 4A:
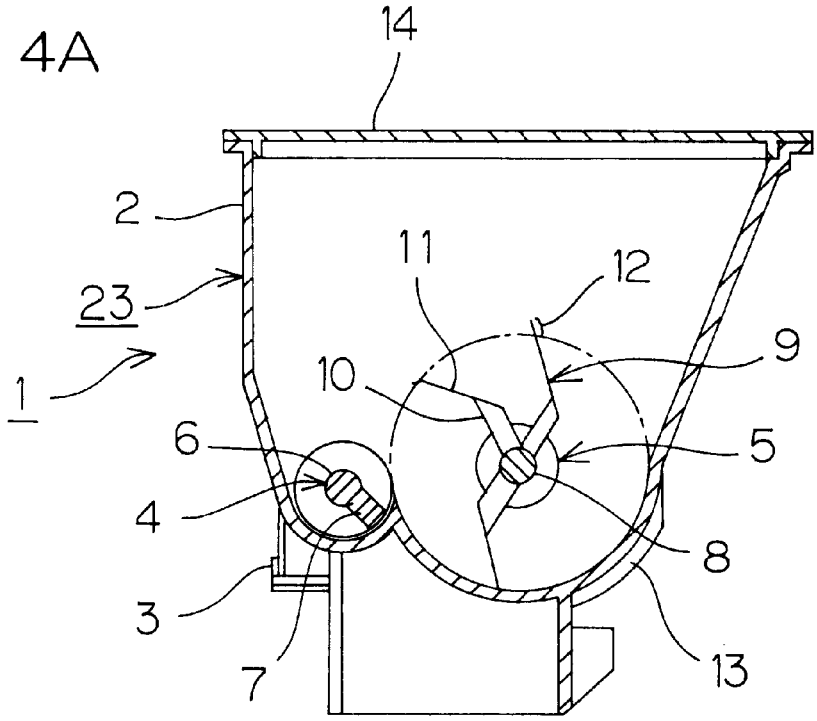
FIG 4A is a sectional view taken along the line A—A in FIG. 2.

FIG. 4A is a sectional view taken along the line A—A in FIG. 2. While the agitating paddle 5 is rotated, the head edge of the agitating wing 9 having no contacting projection 12 thereon does not contact with the spiral blade 7 but slidably contacts with the inner bottom surface of the container 2. Thereby, toner can be prevented from being accumulated in the bottom of the container 2.

Figure 4B:
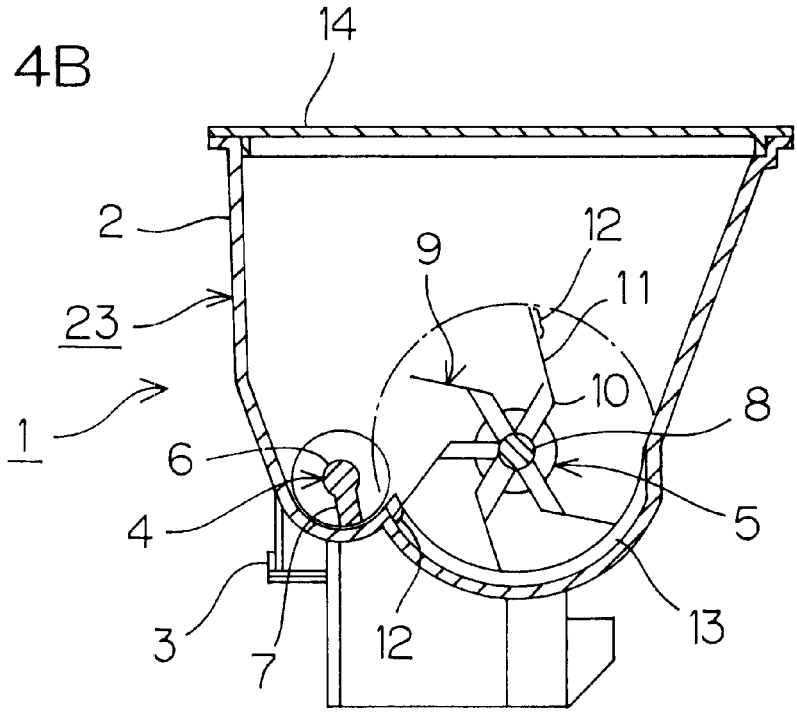
FIG. 4B is a sectional view taken along the line B—B in FIG. 2.

FIG. 4B is a sectional view taken along the line B—B in FIG. 2. When the agitating paddle 5 is rotated, the contacting projection 12 provided on the agitating wing 9 contacts with the spiral blade 7 of the delivering spiral 4. Further, the head edge of the contacting projection 12 slidably contacts with the inner surface of the recessed portion 13 in the container 2 in order to prevent toner from being accumulated in the bottom of the container 2. Accordingly, the recessed portion 13 has a shape projecting outwardly from the bottom of the container 2.

Now, another embodiment of the present invention will be described in the following with reference to FIGS. 1 to 3 again.

Figure 5A:
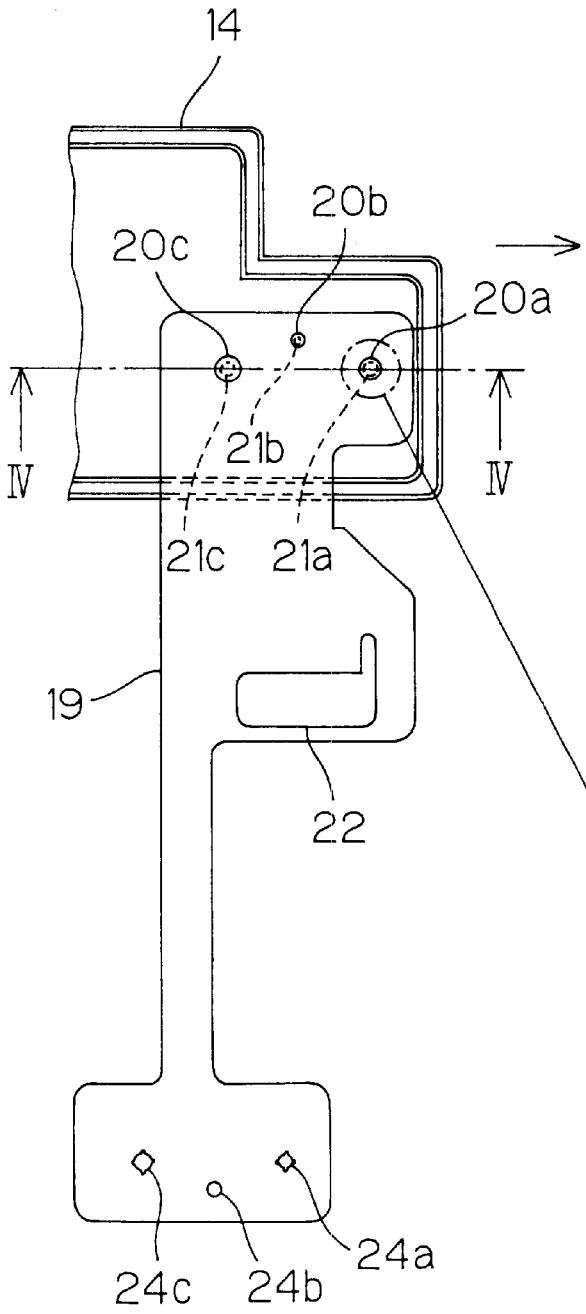
FIGS. 5A and 5B are plan views showing an example of attachment of an oscillating plate to a top plate provided in a toner cartridge of another embodiment of the present invention.
Figure 5B:
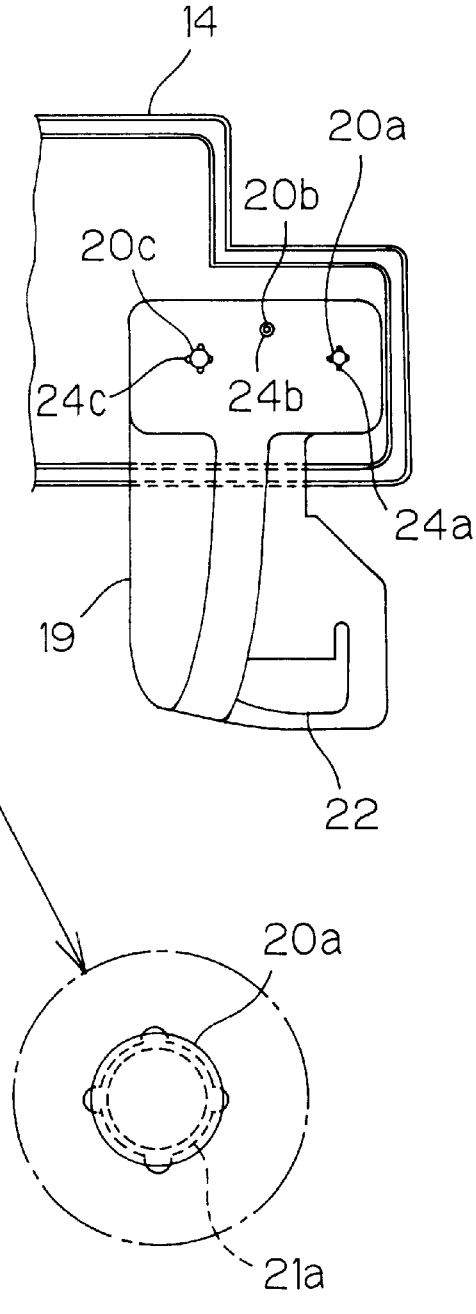

In this embodiment, as shown in FIGS. 5A and 5B, an oscillating plate 19 for assisting in agitating toner is provided instead of or in addition to the abovementioned contacting projections 12 in order to prevent toner blocking or setting.

Specifically, though the spiral blade 7 is provided in the range 15 in which no agitating wing 9 of the agitating paddle 5 can be provided, toner in this range 15 is sometimes insufficiently agitated because of lack of agitating wings 9. Therefore, the oscillating plate 19 is provided in this range 15 in which no agitating wing 9 can be provided.

The oscillating plate 19 is so located as to be in contact with a part of the agitating wing 9 nearest to the side surface 2*b*. When the agitating paddle 5 is rotated, the agitating wing 9 repels the oscillating plate 19, so that the repelled oscillating plate 19 agitates toner. The oscillating plate 19 can agitates toner in the region in which agitating effect of the agitating paddle 5 cannot reach, thereby preventing toner blocking or preventing that toner, not agitated for a long time, sets of itself.

Figure 6:
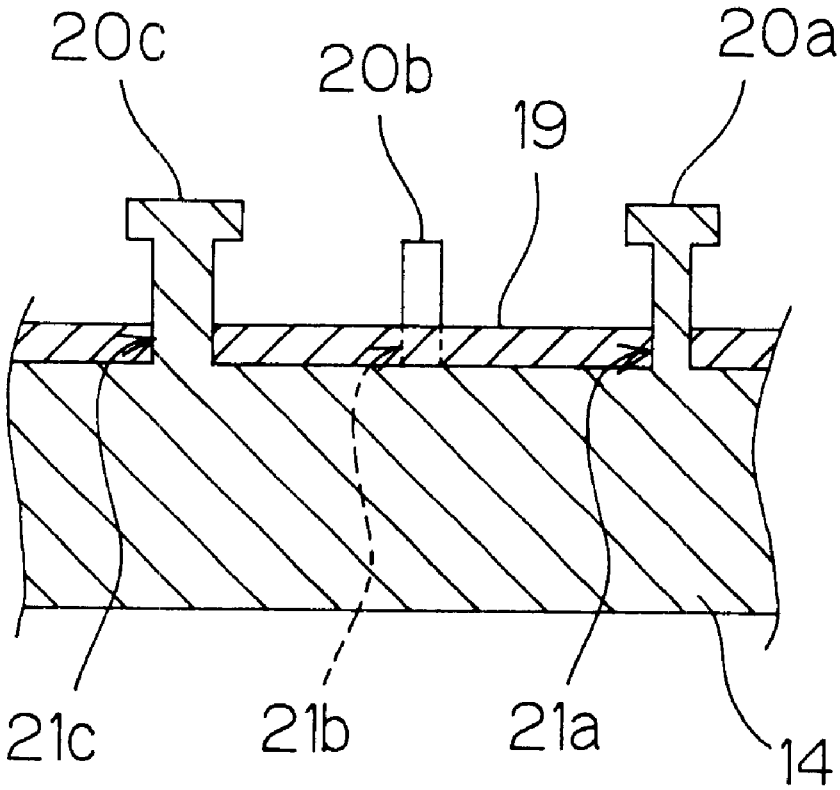
FIG. 6 is a sectional view of the attaching portion of the oscillating plate taken along the line VI—VI in FIG. 5A.

As shown in FIGS. 5A and 5B, the oscillating plate 19 is attached to the top plate 14. The oscillating plate 19 is a long thin plate formed of, for example, a polyethylene terephthalate synthetic resin, and has elasticity and flexibility. The oscillating plate 19 is attached to apart, in the vicinity of the recessed section, of the lower surface of the top plate 14. FIG. 5A is a plan view showing the oscillating plate 19, in which only one end of the oscillating plate 19 is attached to the lower surface of the top plate 14. FIG. 5B is a plan view showing the oscillating plate 19, in which the oscillating plate 19 is curved from the state shown in FIG.5A and the other end thereof is also attached to the lower surface of the top plate 14. FIG. 6 is a sectional view of the attaching portion of the oscillating plate 19 taken along the arrow VI—VI in FIG. 5A.

In FIG. 5A, three projections 20*a*, 20*b*, 20*c* in this order seen from the end of the top plate 14 on the recessed section side are provided on a portion of the lower surface of the top plate 14, to which the oscillating plate 19 is attached. Referring to FIG. 6, the projection 20*a* comprises a cylindrical body and a cylindrical head portion formed on the upper end of the body and having a somewhat larger diameter than that of the body. The projection 20*c* has a length substantially equal to that of the projection 20*a* and outer diameters somewhat larger than those of the projection 20*a*, and comprises a cylindrical body and a cylindrical head portion formed on the upper end of the cartridge body and having a somewhat larger diameter than that of the cartridge body, similarly to the projection 20*a*. The projection 20*b* is in the shape of a cylinder substantially equal to the cylindrical body of the projection 20*a* and has no head portion.

In one end portion of the oscillating plate 19, three fitting holes 21*a*, 21*b*, 21*c* for fitting the projections 20*a*, 20*b*, 20*c* respectively thereinto are provided. Referring to an enlarged view of the projection 20*a* and its circumference in FIG. 5A, the fitting hole 21*a* comprises a circular hole somewhat larger than the cross section of the cylindrical body of the projection 20*a* and somewhat smaller than the cross section of the head portion of the projection 20*a*, and four semicircular holes defined on the periphery of the circular hole spaced from one another with an angle of 90° therebetween. When fitting the projection 20*a* into the fitting hole 21*a*, the fitting hole 21*a* is pressed against the projection 20*a* to elastically deform the periphery of the fitting hole 21*a*, so that the head potion and next the cylindrical cartridge body of the projection 20*a* pass through the fitting hole 21*a*. The fitting hole 21*c* is somewhat larger than the fitting hole 21*a*. The projection 20*c* is fitted into the fitting hole 21*c* by pressing the fitting hole 21*c* against the projection 20*c*, similarly to the case of the fitting hole 21*a*. The fitting hole 21*b* is a circular hole somewhat larger than the cross section of the projection 20*b*, and the projection 20*b* is fitted into the fitting hole 21*b*.

In the other end portion of the oscillating plate 19, fitting holes 24*a*, 24*b*, 24*c* having the same shapes as those of the fitting holes 21*a*, 21*b* and 21*c* respectively are provided. The oscillating plate 19 is curved in the vicinity of the middle portion of the length thereof, and the projections 20*a*, 20*b*,

20*c* are fitted into the fitting holes 24*a*, 24*b*, 24*c* respectively similarly to the fitting holes 21*a*, 21*b*, 21*c*. By curving the oscillating plate 19, repelling force is given to the oscillating plate 19, so that agitating effect can be increased.

The head portions on the upper ends of the projections 20*a*, 20*c* are provided so as to prevent the projections 20*a*, 20*c* from being detached out of the fitting holes 24*a*, 24*c* when the oscillating plate 19 tends to return, by its elasticity, from the state of FIG.5B in which the oscillating plate 19 is curved and the projections 20*a*, 20*b* are fitted to the fitting holes 24*a*, 24*c* to the state of FIG. 5A. Further, the projection 20*b* is fitted into the fitting holes 21*b*, 24*b* so as to prevent the oscillating plate 19 from being displaced in the horizontal direction.

As mentioned above, in this embodiment, since the projections 20*a*, 20*b*, 20*c* are integrally formed with the lower surface of the top plate 14, the oscillating plate 19 can be easily fitted without need of any additional member except the oscillating plate 19. Accordingly, error in assembling the parts can be decreased.

The numbers and shapes of the projections 20*a*, 20*b*, 20*c*, the fitting holes 21*a*, 21*b*, 21*c* and the fitting holes 24*a*, 24*b*, 24*c* are not limited to those mentioned above. Further, the method for fitting the oscillating plate 19 is not limited to that mentioned above, but the oscillating plate 19 may be directly welded to the lower surface of the top plate 14. Further, in this embodiment, the projections 20*a*, 20*c* are provided with head portions respectively so as to prevent the oscillating plate 19 being detached. However, by forming the fitting holes 21*a*, 21*c* and the fitting holes 24*a*, 24*c* somewhat smaller than the cross sections of the projections 20*a*, 20*c* without providing head portions to the projections 20*a*, 20*c*, the fitting holes 21*a*, 21*c* and the fitting holes 24*a*, 24*c* can be engaged with the projections 20*a*, 20*c* in the state in which the hole peripheries of the fitting holes 21*a*, 21*c* and the fitting holes 24*a*, 24*c* press the cylindrical bodies of the projections 20*a*, 20*c* respectively.

Figure 7:
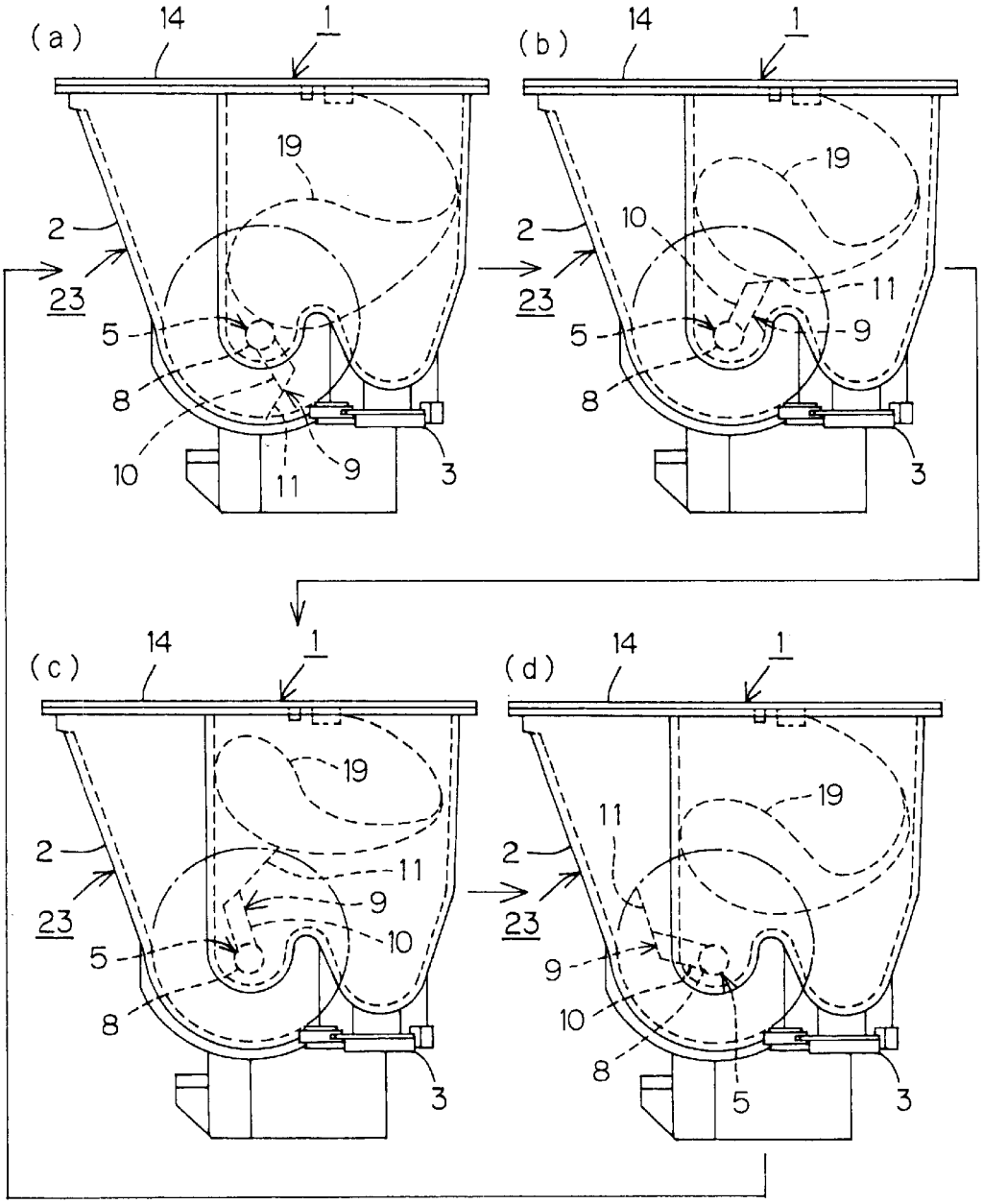
FIGS. 7(*a*)–7(*d*) are side views for explaining toner agitating operation of the oscillating plate.

FIGS. 7 (*a*)–(*d*) are side views showing states of t he oscillating plate 19 agitating toner seen from the side surface 2*b* side. In FIGS. 7(*a*)–(*d*), the oscillating plate 19 is disposed in the vicinity of the side surface 2*b* of the container 2 in such a manner that it is curved and pressed against a art of the inner surface of the container 2 on the front side of the toner cartridge 1 when loaded in an image forming apparatus. Therefore, toner tends to be accumulated in the vicinity of curved middle portion of the oscillating plate 19. An opening for allowing toner to fall down therethrough may be provided near the longitudinally middle portion of the oscillating plate 19 (see FIGS. 5A and 5B). The shape of the opening 22 is not limited to that shown in FIGS. 5A and 5B, but may be any other shape if it allows toner to sufficiently fall down and allows the oscillating plate 19 to have repelling force enough to agitate toner.

In this embodiment, by the rotation of the rotation shaft 8, the blade 11 of the agitating wing 9 nearest to the side surface 2*b* among a plurality of agitating wings 9 repels the oscillating plate 19 at every rotation thereof to operate the oscillating plate 19. Therefore, only the operations of the agitating wing 9 nearest to the side surface 2*b* and the oscillating plate 19 will be described in the following.

The state of the oscillating plate 19 operated by the agitating paddle 5 will be described in order with reference to FIGS. 7(*a*) to 7(*d*).

(a) Before the agitating wing 9 contacts with the oscillating plate 19, the oscillating plate 19 is disposed in the state supported by the rotation shaft 8 of the agitating paddle 5.

(b) When the agitating wing 9 contacts with the oscillating plate 19, the oscillating plate 19 is slidably raised by the side surface of the blade 11 of the agitating wing 9.

(c) The oscillating plate 19 is raised to the highest position by the head side of the blade 11.

(d) The agitating wing 9 and the oscillating plate 19 separate from each other, and the oscillating plate 19 returns to the original position by the elasticity thereof. Then the operations (a) to (d) are repeated.

Further, since the oscillating plate 19 is fitted in somewhat twisted state as shown in FIGS. 7(*a*)–(*d*), it, when operated, generates a complicated locus, unlike a linear reciprocating movement of an oscillating plate in the form of a thin plate only one end of which is fitted to the lower surface of the top plate 14. In concrete, the oscillating plate 19 is raised with being displaced gradually toward the side surface 2*b*, and after the oscillating plate 19 is separated from the agitating wing 9, the oscillating plate 19 returns gradually toward the side surface 2*a* side to reach the original position.

By the abovementioned series of movements of the oscillating plate 19, toner in the region of the cartridge body 23 in which no agitating wing can be provided can be sufficiently agitated. Consequently, toner blocking in this region can be prevented, and toner can be wholly delivered.

Although the present invention has been described and illustrated in detail, it is clearly understood that the same is by way of illustration and example only and is not to be taken by way of limitation, the spirit and scope of the present invention being limited only by the terms of the appended claims.

This application corresponds to the Japanese Patent Applications No.2000-156544 and No.2000-156545 filed in the Japan Patent office on May 26, 2000, and the whole disclosures of these Japanese applications are incorporated herein by

What is claimed is:

1. A toner cartridge comprising:

a cartridge body for containing toner, a delivering spiral, provided within the cartridge body, for delivering toner in the cartridge body including an elongated rotation shaft and a spiral blade extended outward from a circumferential surface of the rotation shaft and continuously elongated in a longitudinal direction of the rotation shaft to form a spiral having a predetermined pitch, an agitating paddle, provided within the cartridge body, for agitating toner, the agitating paddle being provided with a second elongated rotation shaft disposed in parallel with the rotation shaft of the delivering spiral and a plurality of agitating wings protruded from the rotation shaft, a toner blocking/setting prevention member operative in cooperation with the agitating paddle for preventing toner in the cartridge body from blocking or setting, the toner blocking/setting prevention member including a contacting projection provided on each agitating wing so that the contacting projection can contact with the spiral blade when the agitating paddle is rotated.

2. A toner cartridge as claimed in claim 1, in which the contacting projection has a width substantially equal to a pitch of the spiral blade.

3. A toner cartridge as claimed in claim 1, in which any of the plurality of agitating wings are provided with the contacting projection.

4. A toner cartridge as claimed in claim 1, in which the agitating paddle has, in a longitudinal direction thereof, one range in which no agitating wing can be provided and the other range in which at least one of the agitating wings can be provided, and two agitating wings among the plurality of the agitating wings are each provided with the contacting projection.

5. A toner cartridge as claimed in claim 4, in which the cartridge body has a recessed section in a vicinity of one side surface thereof, and the range in which no agitating wing can be provided is a range in which no agitating wing can be provided because of the recessed section, while the range in which agitating wings can be provided is a range in which agitating wings can be provided without interference with the recessed section.

6. A toner cartridge as claimed in claim 4, in which the two contacting projections are provided on the agitating wings within regions, each corresponding to three tenths of the whole of the range in which agitating wings can be provided, extending from each end of the range.

7. A toner cartridge comprising:

a cartridge body for containing toner, in which the cartridge body has a top plate, an agitating paddle, provided within the cartridge body, for agitating toner, and a toner blocking/setting prevention member operative in cooperation with the agitating paddle for preventing toner in the cartridge body from blocking or setting, in which the blocking/setting prevention member includes an oscillating plate which is fixed to the top plate of the cartridge body and is operated by the agitating paddle to assist in agitating toner.

8. A toner cartridge as claimed in claim 7, in which the cartridge body includes a region out of reach of the agitating effect of the agitating paddle, and the oscillating plate is provided in that region.

9. A toner cartridge as claimed in claim 7, in which the oscillating plate comprises an elastic and flexible thin plate and is fixed in a curved state to the cartridge body at its both ends.

10. A toner cartridge comprising:

a cartridge body for containing toner, an agitating paddle, provided within the cartridge body, for agitating toner, and a toner blocking/setting prevention member operative in cooperation with the agitating paddle for preventing toner in the cartridge body from blocking or setting, in which the blocking/setting prevention member includes an oscillating plate which is operated by the agitating paddle to assist in agitating toner and wherein the oscillating plate is disposed in such a manner that the agitating paddle during rotating can repel the oscillating plate, and the repelled oscillating plate can agitate toner in the cartridge body.

11. A toner cartridge as claimed in claim 10, in which the cartridge body includes a region out of reach of the agitating effect of the agitating paddle, and the oscillating plate is provided in that region.

12. A toner cartridge as claimed in claim 10, in which the oscillating plate comprises an elastic and flexible thin plate and is fixed in a curved state to the cartridge body at its both ends.

* * * * *